United States Patent [19]

Wheeler

[11] Patent Number: 4,502,870

[45] Date of Patent: Mar. 5, 1985

[54] METHOD AND APPARATUS FOR CONTROLLING TUMBLING HAMMER RAPPER FOR ELECTROSTATIC PRECIPITATOR

[75] Inventor: Harry L. Wheeler, Birminham, Ala.

[73] Assignee: Combustion Engineering, Inc., Windsor, Conn.

[21] Appl. No.: 477,103

[22] Filed: Mar. 21, 1983

[51] Int. Cl.[3] ..... B03C 3/76

[52] U.S. Cl. ..... 55/13; 55/104; 55/112; 340/683; 340/686

[58] Field of Search ..... 55/13, 104, 106, 274, 55/300, 112; 73/432 V; 340/672, 683, 686

[56] References Cited

U.S. PATENT DOCUMENTS

| | | | |
|---|---|---|---|
| 2,190,682 | 2/1940 | Satterlee | 340/672 |
| 2,819,359 | 1/1958 | Johnson | 340/686 |
| 3,527,905 | 9/1970 | Kanamedoi | 340/672 |
| 4,035,165 | 7/1977 | Archer | 55/13 |
| 4,358,735 | 11/1982 | Boys | 340/672 |

FOREIGN PATENT DOCUMENTS

| | | | |
|---|---|---|---|
| 722833 | 11/1965 | Canada | 340/686 |

*Primary Examiner*—David L. Lacey
*Attorney, Agent, or Firm*—David L. Smith

[57] ABSTRACT

In a tumbling hammer type rapper (10), a feedback signal is provided via limit switch (30) and cam (28) mounted on rapper shaft (14) to control the rotation of rapper shaft (14) through one revolution. Rapper shaft (14) rotation is monitored to ensure that rapper shaft (14) completes one revolution, returning to the initial position, within a normal predetermined time period. If rapper shaft (14) fails to rotate from the initial position or fails to complete one revolution within the normal predetermined time period, an alarm is energized.

11 Claims, 3 Drawing Figures

METHOD AND APPARATUS FOR CONTROLLING TUMBLING HAMMER RAPPER FOR ELECTROSTATIC PRECIPITATOR

BACKGROUND OF THE INVENTION

The present invention relates to electrostatic precipitators and more particularly to a method and apparatus for monitoring and controlling tumbling hammer rappers.

Electric precipitators contain a plurality of electrodes for electrostatically removing particulate matter suspended in the gas passing therethrough. The particulate matter is attracted by and accumulates on the electrodes. A sufficient amount of particulate matter build-up causes a decrease in the efficiency of particulate matter removal as well as other detrimental effects. It is therefore necessary to clean the electrodes for particulate matter disposal and to maintain efficiency of particulate matter removal while minimizing the other detrimental effects of accumulated particulate matter on the electrodes.

A tumbler hammer type rapper is commonly used for removal of accumulated particulate matter from the collecting and discharge electrodes of electrostatic precipitators. In a tumbler hammer type rapper, each of the plurality of tumbling hammers is pivotally attached to a disk which in turn is rigidly attached to a rapper shaft. As the rapper shaft rotates through each revolution (one cycle), the hammers are first raised then fall under the force of gravity as they pivot on the disk and strike an anvil attached to either a collecting or discharge electrode, thereby vibrating the struck electrode causing the particulate matter accumulated thereon to fall into a collection hopper below.

One known method of cleaning the electrodes of an electrostatic precipitator is to periodically energize a drive unit to rotate the rapper shaft of the tumbler hammer type rapper. The drive unit is energized for a predetermined time period of sufficient duration to rotate the rapper shaft at least one revolution.

However, there is no feedback signal to indicate that indeed the rapper shaft has rotated. Therefore, a need exists for monitoring the rotation of a tumbler hammer type rapper shaft and providing a feedback signal to assure proper rotation. A further need exists to allow only one strike from each hammer for each cycle of operation of the tumbler hammer type rapper to minimize reentrainment of particulate matter. Should the tumbler hammer type rapper shaft fail to rotate, the feedback signal would be utilized to initiate an alarm indicating the tumbler hammer type rapper has malfunctioned.

SUMMARY OF THE INVENTION

The present invention provides a feedback signal to assure the tumbler hammer type rapper has operated through its cycle properly or in the alternative provides an alarm signal if the tumbler hammer type rapper fails to operate properly. Upon the initiation of the signal to rotate the rapper shaft, rotation of the rapper shaft is monitored to assure that the rapper shaft rotates from the initial position. Rapper shaft rotation is further monitored to assure that the rapper shaft completes one revolution, returning to the initial position, within a normal predetermined time period. If the shaft fails to rotate from the initial position or fails to complete one revolution within the normal predetermined time period, an alarm is energized.

DESCRIPTION OF THE PREFERRED EMBODIMENT

Figure 1:
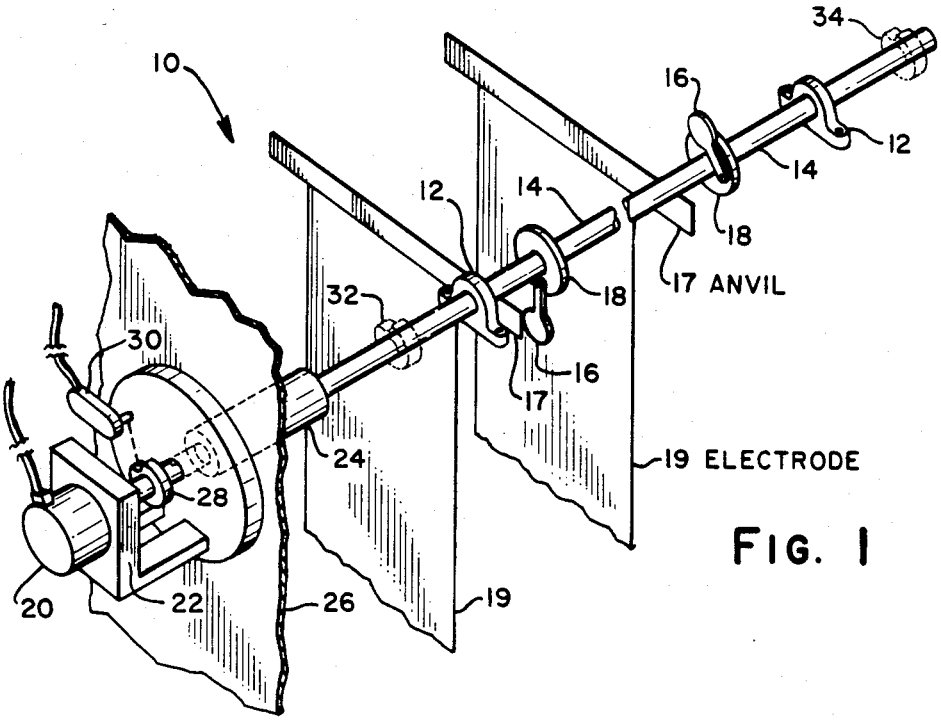
FIG. 1 is a schematic view of an electric precipitator tumbler hammer type rapper drive designed in accordance with the present invention.

Refering to the drawing, there is depicted therein a tumbler hammer type rapper 10 designed in accordance with the present invention as best seen in FIG. 1. Shaft supports 12 provide support along the length of rapper shaft 14. Tumbler hammers 16 are pivotally mounted on discs 18 which in turn are rigidly mounted on rapper shaft 14. As rapper shaft 14 rotates tumbler hammers 16 are first raised then fall under the force of gravity as they pivot on discs 18 and strike an anvil (17) attached to either a collecting or discharge electrode 19. The struck electrode vibrates causing particulate matter adhering thereto to fall into a collction hopper below with some particulate matter reentrained in the gas stream. Tumbler hammers 16 when in contact with the anvil of a discharge electrode are at the same high voltage as the discharge electrode necessitating insulating rapper shaft 14 from drive motor 20 and gear reducer 22 by drive insulator 24. Drive motor 20 and gear reducer 22 are located outside of precipitator wall 26. Cam 28, mounted on rapper shaft 14, may be a notched disc or lobe cam and is used to actuate limit switch 30. Although the location of cam 28 is shown outside precipitator wall 26, alternate cam positions are shown at 32 and 34.

Since some particulate matter is reentrained in the gas stream each time a hammer 16 strikes an anvil 17, it is preferable to limit to one the number of times a hammer 16 strikes an anvil 17 during each cycle of operation of the tumbler hammer type rapper. This assures that each electrode 19 has been vibrated thereby removing particulate matter adhering thereto, while minimizing the reentrainment of particulate matter. All hammers 16 do not necessarily strike anvils 17 simultaneously due to the relative positions of the pivotal mounts around rapper shaft 14. However, each revolution of rapper shaft 14 causes each hammer 16 mounted therefrom to strike an anvil 17 only once. Therefore, controlling the rotation of rapper shaft 14 through one and only one revolution per cycle of tumbler hammer type rapper operation assures the desired result is achieved.

Figure 2:
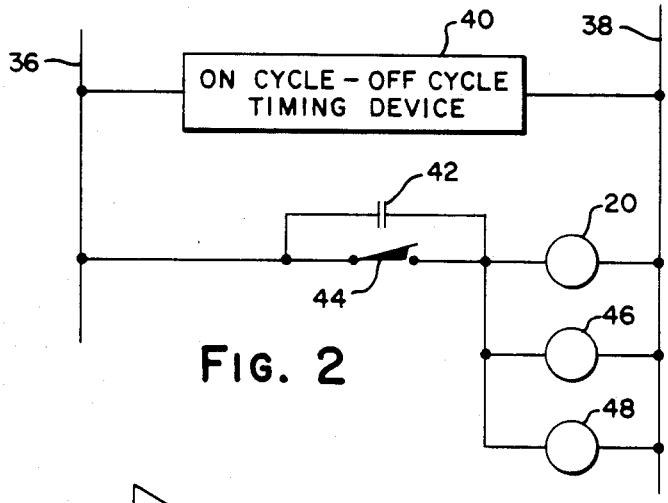
FIG. 2 is a schematic drawing of the control system of the present invention.
Figure 3:
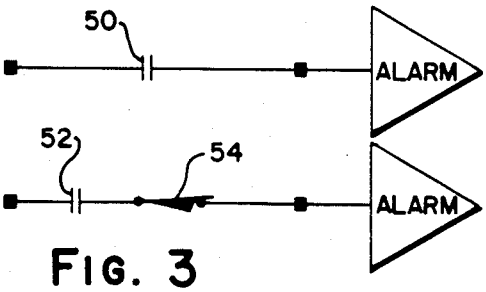
FIG. 3 is a schematic drawing showing the associated alarm contacts.

The control system to control and monitor the tumbler hammer type rapper of FIG. 1 is shown in FIG. 2. The alarm contacts associated with the control system are shown in FIG. 3. Power is supplied to the control system by conductor pair 36,38. On cycle-off cycle timing device 40 periodically initiates the tumbler hammer type rapper cycle. The cycle is initiated by closing contact 42 for approximately 10 seconds thereby energizing rapper shaft drive motor 20. Time delays 46 and 48 are energized simultaneously with drive motor 20.

Time delay 48 is set to time out thereby closing contact 50 at a predetermined time period slightly greater than the normal time required for drive motor 20 to rotate rapper shaft 14 one revolution. Time delay 48 is used to detect that rapper shaft 14 has failed to return to the initial position or has required more than a normal time to make one revolution.

Time delay 46 is set to time out thereby closing contact 52 at a predetermined time period slightly less than the duration of contact 42 remaining closed. Time delay 46 is used to detect failure of rapper shaft 14 to rotate after drive motor 20 is energized.

Once drive motor 20 is energized, one of three operating conditions occurs. The first operating condition is the normal operating condition wherein rapper shaft 14 rotates one revolution and no alarms are initiated. The second operating condition results in rapper shaft 14 not rotating from the initial position and an alarm to indicate failure to rotate is initiated. The third operating condition that may result is a failure of rapper shaft 14 to return to the original rapper shaft 14 position or alternatively to require a greater than normal time period to make one revolution.

In normal operation, the tumbler hammer type rapper cycle is initiated by on cycle-off cycle timing device 40 closing contact 42 for a duration of approximately 10 seconds. The initial position of rapper shaft 14 as well as rotation of rapper shaft 14 from the initial position are sensed by limit switch 30 which is comprised of contacts 44 and 54. Rapper shaft 14 begins rotation simultaneously with initiating the timing cycles of time delay 46 and time delay 48. As drive motor 20 rotates rapper shaft 14 from the initial position, cam 28 rotates causing contact 44 of limit switch 30, normally open in the initial position, to close. Simultaneously with contact 44 closing, contact 54 of limit switch 30, which is normally closed in the initial rapper shaft 14 position, opens.

With contact 44 closed before contact 42 opens, drive motor 20 remains energized beyond the approximate 10 seconds that contact 42 is closed. Shortly before contact 42 opens, time delay 46 times out closing contact 52. Since contact 54 previously opened, no alarm is sounded.

Drive motor 20 remains energized until rapper shaft 14 completes one revolution and limit switch 30 senses the completed revolution via a detente in cam 28. The time required for completing one revolution, typically one to two minutes, is greater than the duration of contact 42 remaining closed. Upon completion of one revolution of rapper shaft 14, limit switch 30 contact 54 closes and limit switch 30 contact 44 opens deenergizing drive motor 20, resetting time delay 46 and resetting time delay 48. Using a feedback signal based on rapper shaft 14 position assures that when contact 44 opens deenergizing drive motor 20, rapper shaft 14 will stop in the same position after each cycle in operation and that cycle is one revolution of rapper shaft 14.

Deenergizing time delay 46 resets time delay 46 thereby opening contact 52; contact 52 is opened simultaneously with the closing of the contact 54 obviating a failure to rotate alarm condition. Time delay 46 is in a state to start timing upon initiation of a subsequent tumbler hammer rapper cycle.

Deenergizing time delay 48 resets time delay 48 before time delay 48 times out. Contact 50 is thereby prevented from closing obviating a failure to rotate fully alarm condition. Time delay 48 is in a state to start timing upon initiation of a subsequent tumbler hammer rapper cycle.

Should the tumbler hammer type rapper cycle be initiated and rapper shaft 14 fail to rotate after contact 42 is closed, contact 44 of limit switch 30 remains opened, contact 54 of limit switch 30 remains closed and before contact 42 opens time delay 46 times out closing contact 52 thereby initiating a no rotation alarm.

If rapper shaft 14 begins to rotate when contact 42 is closed and either fails to complete one revolution or requires a longer than normal time period to complete one revolution a failure to rotate fully alarm is initiated. When contact 42 is closed initiating a tumbler hammer type rapper cycle, and rapper shaft 14 rotates from the initial position, contact 44 of limit switch 30 closes and contact 54 of limit switch 30 opens before contact 42 opens. Therefore, a failure to rotate alarm is not initiated. Rapper shaft 14 requiring a longer than normal time to complete one revolution or failing to complete one revolution maintains contact 44 of limit switch 30 closed permitting time delay 48 to time out closing contact 50 thereby initiating a failure to rotate fully alarm.

What is claimed is:

1. In an electrical precipitator having electrically chargable electrodes, each having an anvil, for electrostatically removing particulate matter from a particulate entrained gas stream passing therethrough and a rapper shaft proximate the anvils having rapper means for striking the anvils thereby causing the electrodes to vibrate so as to disengage particulate matter deposited thereon, a method of controlling the rotation of the rapper shaft, comprising:

a. sensing the initial position of the rapper shaft;
b. initiating rotation of the rapper shaft;
c. sensing the rotation of the rapper shaft from the initial position; and
d. stopping the rapper shaft rotation upon completion of one revolution.

2. A method of controlling the rotation of a rapper shaft as described in claim 1 wherein the step of sensing the rotation of the rapper shaft from the initial position further comprises initiating an alarm upon failure of the rapper shaft to rotate from the initial position.

3. A method of controlling the rotation of a rapper shaft as described in claim 1 wherein the step of sensing the rotation of the rapper shaft from the initial position further comprises initiating an alarm upon failure of the rapper shaft to rotate one complete revolution.

4. A method of controlling the rotation of a rapper shaft as described in claim 3 further comprising:

measuring the elapsed time from initiating rotation of the rapper shaft; and initiating an alarm when the measured elapsed time from initiating rotation of the rapper shaft exceeds a predetermined normal time required for the rapper shaft to rotate through one revolution.

5. In an electrical precipitator having electrically chargable electrodes, each having an anvil, for electrostatically removing particulate matter from a particulate entrained gas stream passing therethrough, apparatus for controlling the rotation of a rapper shaft, comprising:

a. a shaft proximate the anvils having rapper means mounted therefrom for striking the anvils;
b. means for rotating the shaft;
c. means for periodically energizing the shaft from rotating means to initiate a shaft revolution;
d. means for sensing the rotation of the shaft from an initial position; and
e. means for sensing the shaft has rotated one revolution thereby returning to the initial position, whereby during the one revolution the rapper means strike the anvils causing the electrodes to vibrate thereby disengaging particulate matter deposited thereon, the disengaged particulate matter gravitating to the bottom of the precipitator for removal and disposal.

6. An electrostatic precipitator as recited in claim 5 having apparatus for controlling the rotation of the rapper shaft further comprising:

means for initiating an alarm upon failure of the rapper shaft to rotate one complete revolution.

7. An electrostatic precipitator as recited in claim 5 having apparatus for controlling the rotation of the rapper shaft further comprising:

means for initiating an alarm upon failure of the rapper shaft to rotate from the initial position.

8. An electrostatic precipitator as recited in claim 5 having apparatus for controlling the rotation of the rapper shaft wherein the means for rotating the shaft further comprises a gear reduction.

9. An electrostatic precipitator as recited in claim 5 having apparatus for controlling the rotation of the rapper shaft wherein the means for rotating the shaft is an electric motor.

10. An electrostatic precipitator as recited in claim 9 having apparatus for controlling the rotation of the rapper shaft wherein the means for rotating the shaft further comprises a gear reduction interposed between the electric motor and the rapper shaft.

11. An electrostatic precipitator as recited in claim 5 having apparatus for controlling the rotation of the rapper shaft wherein the means for sensing the rotation of the shaft from the initial position comprises:

a. a cam mounted on the rapper shaft having a detente; and b. a limit switch to monitor the surface of the cam to detect the detente in the cam.

* * * * *